US005740867A

United States Patent [19]

Jansson

[11] Patent Number: 5,740,867

[45] Date of Patent: Apr. 21, 1998

[54] DEVICE FOR PREVENTING THE RISK OF FIRE DUE TO BURNING OR GLOWING PARTICLES IN A PIPELINE

[75] Inventor: Lennart Carl Erik Jansson, Värmdö, Sweden

[73] Assignee: Firefly AB, Huddinge, Sweden

[21] Appl. No.: 624,473

[22] PCT Filed: Oct. 3, 1994

[86] PCT No.: PCT/SE94/00907

§ 371 Date: Apr. 3, 1996

§ 102(e) Date: Apr. 3, 1996

[87] PCT Pub. No.: WO95/10329

PCT Pub. Date: Apr. 20, 1995

[30] Foreign Application Priority Data

Oct. 8, 1993 [SE] Sweden ..... 9303305

[51] Int. Cl.[6] ..... A62C 3/00

[52] U.S. Cl. ..... 169/60; 169/54; 169/61

[58] Field of Search ..... 169/54, 60, 61; 340/578, 584; 250/339.15, 554

[56] References Cited

U.S. PATENT DOCUMENTS

| | | | |
|---|---|---|---|
| 3,909,954 | 10/1975 | Zoukourian | 169/61 X |
| 5,154,237 | 10/1992 | Cooper | 169/54 |
| 5,193,622 | 3/1993 | Tibbling | 169/54 |

FOREIGN PATENT DOCUMENTS 1729528 4/1992 U.S.S.R. .

OTHER PUBLICATIONS

"Unit for Smouldering Particles Detection in Pneumo Transport Ducts—Using Light Conductors Whose Receiving Ends Are Situated in Fan, and Are In Plane Perpendicular to Material Flow Direction", Derwent's Abstract, No. 93-115518/14, week 9314, Abstract of SU 1729528 (Optical Inst Vavilov), 30 Apr. 1992.

*Primary Examiner*—Andrew C. Pike

*Attorney, Agent, or Firm*—Burns, Doane, Swecker & Mathis L.L.P.

[57] ABSTRACT

A preventive safety system may be used in a process in which loosely formed process material is produced in a first unit (1) and is transportable to a receiving, second unit (2), and in which process the treatment of material in the first unit is liable to generate a hazardous particle or particles which has/have a temperature which is sufficiently high to initiate burning and/or an explosion in at least the second unit. The requisite transportation of the loosely formed material between the first unit and the second unit is effected through the medium of a stabilizing zone (7), an indicating zone (8) operative in indicating the presence of hazardous high-temperature particles, and an extinguishing zone (9), wherein the indicating zone (8) includes one or more hazardous particle sensors, wherein the sensors coact with an indicating and activating unit (12) such that when the presence of hazardous high-temperature particles is detected by a sensor (10) a device (15) is activated by the indicating and activating unit. The device (15) is located in the extinguishing zone and functions to deliver an extinguishing agent and/or to remove said hazardous particles from the system. A detection-dependent intensity can be evaluated in the activating unit (12) and that measure or procedure which is most suitable at that time selected in the indicating and activating unit (12) from a number of available safety measures and safety procedures (19, 20, 21).

10 Claims, 1 Drawing Sheet

DEVICE FOR PREVENTING THE RISK OF FIRE DUE TO BURNING OR GLOWING PARTICLES IN A PIPELINE

TECHNICAL FIELD

The present invention relates to a preventive safety system and then particularly, but not exclusively, to a system which can be applied in a process, normally an industrial process, in which loosely formed material is produced in a first unit and transported from said unit to a receiving, second unit.

By loosely formed material, it is meant any type of material that can be transported by a vehicle gas or in a gas or gaseous mixture, normally air, in which the particles of material are mutually discrete.

Material of the kind meant here may consist in extremely fine, dust-like particles. It may also consist in powdery material or granular particles, and also wood chips, pellets, straw, and like transportable materials.

The concept on which the present invention is based requires the treatment of the material within the first unit to be liable to generate individual particles or several discrete particles that have been heated to a temperature which is sufficiently high to cause a fire and/or an explosion within the selected transportation path and/or at least within the second unit.

The path along which the loosely formed material is transported between the first unit and the second unit will typically include a stabilizing zone (or disturbance zone), an indicating zone which is operative in indicating the presence of hazardous high-temperature particles, an effectuating zone, an extinguishing zone, and a risk zone.

The stabilizing zone is intended to enable those particles of low energy content and which do not constitute a fire or an explosion risk within the downstream zones, and particularly the risk zone, to reduce their energy content so that these particles will not be indicated by the indicating zone located immediately downstream.

Located within the indicating zone are one or more sensors or detectors which are intended to indicate the presence of particles whose energy contents are sufficiently high to incite burning, i.e., fire, when the particles arrive in the downstream zones and then particularly in the risk zone. The sensors are arranged to coact with an indicating and activating unit such that when one of the sensors detects the presence of such high-temperature particles, there is activated a device or an arrangement which delivers an extinguishing agent and/or removes said particles from the system and which coacts with the extinguishing zone.

The indicating zone is followed by an effectuating zone whose length is so adapted that, upon activation of a device within the extinguishing zone, the device will have time to form an extinguishing barrier before or when the particle or particles reach said zone.

The extinguishing zone may also have the form of a valve which functions to deflect particle collections that include said high temperature particles from the transportation path leading to the risk zone.

DESCRIPTION OF THE PRIOR ART

A preventive safety system of the aforedescribed kind is known and marketed by Firefly AB, Huddinge, Sweden. The purpose of the preventive safety system is to indicate the presence of sparks and glowing particles and to apply an extinguishing agent or a smothering agent which will prevent glowing particles from reaching a downstream process unit, such as a filter, a silo, or like device in which combustion and/or an explosion could otherwise occur.

Also pertinent to the present standpoint of techniques is the fact that the risk of fire and explosion in modern industrial processes increases with increasing and higher production rates and within larger production plants.

As volumes of material that are transported have successively become greater, practical experience has shown that most fires and explosions that occur in modern process plants are caused by sparks, glowing particles, and airborne burning flakes or the like. Although these sparks, glowing particles, etc., have a very small energy content, the energy content is, nevertheless; sufficiently high to initiate a fire and/or an explosion.

It is thus known to take certain measures or procedures in an attempt to indicate as quickly as possible those particles, and only those particles, which in themselves give an incitement to fire and explosion, so as to be able to restrict the effects thereof.

One of the many fields of application to which the present invention pertains is the case when paper pulp is milled to cellulose fluff which is transferred to a silo through the medium of a pneumatic transport system.

In this regard, it has been necessary to include a stabilizing zone in the transportation line of earlier known safety systems, whereby the sensor or detector is placed at such a distance from the producing unit that any occurrent hazardous particles and/or sparks that may have occurred will have been rendered safe or extinguished.

It has also been found necessary to provide a sensor-including indication zone and an effectuation zone wherein the distance between the sensor and extinguishing equipment must be sufficiently long to enable an extinguishing zone to be effectuated prior to a detected hazardous particle reaching a downstream risk zone.

It is also proposed that there is provided an extinguishing zone whose length has been adapted so that any occurrent and detected hazardous particles can be rendered harmless prior to reaching the risk zone.

Also proposed is the possibility of shutting down the air transportation means and of generating an inert atmosphere in the vicinity of the risk zone.

The second unit, i.e., the receiving unit, can also be defined as a risk zone, since this unit may consist in a volume in which the transported product or material is so concentrated as to represent a serious fire and explosion risk.

SUMMARY OF THE INVENTION

Technical Problems

When considering the state of the prior art as described above, it will be seen that a technical problem resides in the significance of using sensors which are so constructed as to enable a risk factor to be evaluated on the basis of the intensity of said individual or several particles heated to a temperature at which the initiation of a fire and/or an explosion can be expected in at least the second unit, and to evaluate on the basis of the risk factor thus obtained and with the aid of circuits included in the unit make a suitable selection of an appropriate measure or procedure to eliminate the fire incitement.

It will also be seen that in the case of a preventive safety system of the kind defined in the introduction, a technical problem resides in the ability to provide conditions by means of which further conditions can be created, with the aid of the indicating and activating unit, which will enable the individual or several hazardous particles or a fire to be extinguished or eliminated effectively without needing to exceed to any great extent the effect of the requisite extinguishing measures or procedures and/or the requisite duration of such measures or procedures, such as to cause harm to the material.

It will also be seen that a technical problem is one of providing conditions which will enable the evaluated and chosen measures or procedures to be taken from a plurality of available devices and/or to use an existing device to a greater or lesser extent.

It will also be seen that a technical problem is one of creating with the aid of the indicating and activating unit conditions such that the appropriate measures or procedures taken are dependent on the nature of the process itself, thereby enabling one and the same equipment to be used for different situations.

Another technical problem resides in realizing the conditions that are required in order to generate combined activation of a valve which will function to remove from the system material collections that include hazardous particles.

It will also be seen that a technical problem is one of creating with the aid of said indicating and/or activating unit initiating processes which will activate the whole of a water-based extinguishing system or only selected parts of said system, or which will fully or partially activate the supply of a fire extinguishing or a glowing-particle smothering gas, such as an inert gas or some other appropriate gas, depending on the seriousness of the hazard detected by the sensors.

Another technical problem resides in realizing those advantages that are afforded when the indicating and activating unit can be programmed, thereby enabling process-related conditions to be program-controlled.

It will also be seen that another technical problem is one of realizing those advantages that are afforded when the indicating and activating unit can be programmed while observing the construction and method of operation of the extinguishing equipment, such as to enable an extinguishing zone to be constructed immediately before and/or when a hazardous particle or particles reaches or reach the extinguishing zone prior to entering the risk zone, and also to be able to observe the instantaneous rate of particle transportation.

Solution

The present invention provides a solution to one or more of the aforesaid technical problems and takes as its starting point a known preventive safety system of the kind defined in the introduction.

According to the present invention, the detection-dependent intensity of hazardous particles can be evaluated in the indicating and activating unit, and the choice of an appropriate measure or procedure is effected in said unit in accordance with conditions or provisions stored in said indicating and activating unit.

According to proposed embodiments that lie within the scope of the present invention, the measure or procedure chosen by the unit is one of a plurality of available devices and/or consists in the greater or lesser use of one and the same device.

According to the invention, the choice of a suitable procedure or measure can be made in accordance with the nature of the process and also in accordance with other criteria which enable a preventive safety system to be used and also to be adapted to suit different processes.

One of the aforesaid measures or procedures may reside in the activation of a valve which functions to deflect a material collection which includes hazardous particles from the normal transportation path leading to the risk zone.

According to another embodiment of the invention, the sensor or sensors will be placed at a distance from said first unit such that produced particles which have a low, risk-free energy content will be able to pass respective sensors without initiating a safety process in said unit.

The measure or procedure chosen may also consist in fully or partially activating a water-based extinguishing system.

The measure or procedure may also consist in fully or partially activating a gas, water vapor, or like fire-requiring extinguishing system.

It is also proposed that the unit can be programmed so as to be able to observe process-related conditions.

According to another embodiment, the unit can be programmed so as to take into account the construction and method of operation of the extinguishing equipment fitted, so as to enable an effective extinguishing zone to be formed or constructed immediately before a hazardous particle enters the risk zone, in which regard information relating to the speed of transportation of the particles is required.

Advantages

Those advantages that are primarily afforded by an inventive preventive safety system reside in the provision of conditions which will enable one single piece of equipment to be adapted to suit a number of different processes and, in response to the intensity of the detection of several sensors, the indicating and activating unit is able to select one of several available and suitable measures or procedures, such as activating fully or partially a water-based extinguishing system, or fully or partially activating a gas, water vapor, or like system.

BRIEF DESCRIPTION OF THE DRAWING

An exemplifying embodiment of an inventive preventive safety system which can be used within an exemplifying process will now be described in more detail with reference to the accompanying drawing, in which.

DESCRIPTION OF EMBODIMENTS PRESENTLY PREFERRED

Figure 1:
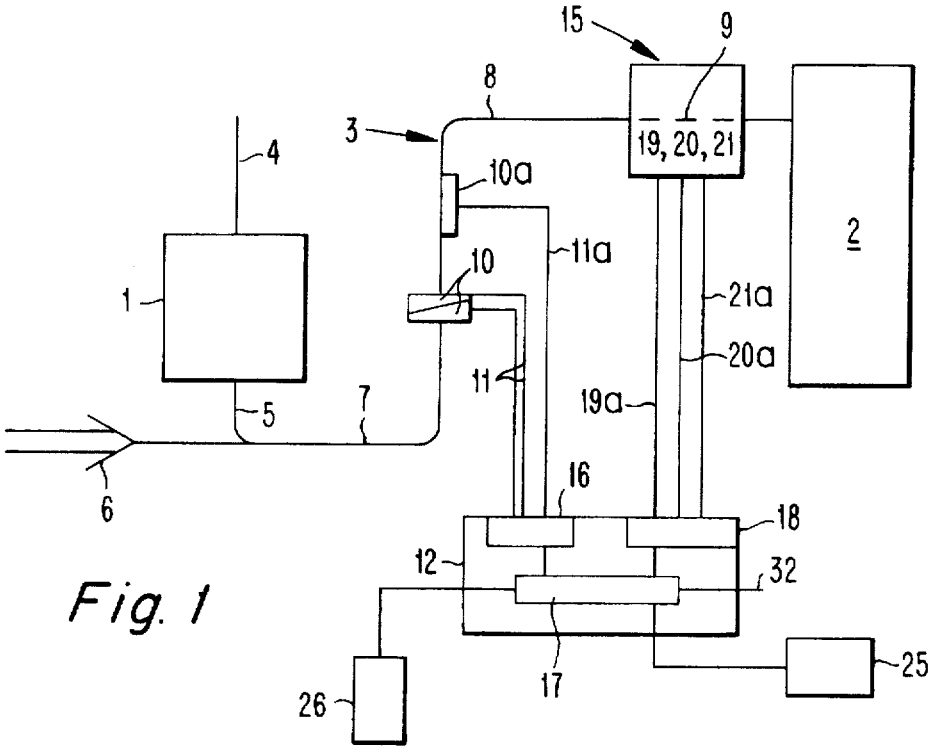
FIG. 1 is a block schematic illustrating generally a process in which there is used an indicating and activating unit according to the present invention.

FIG. 1 illustrates a preventive safety system which can be used within a process, an industrial process, in which loosely formed process material is produced within a first unit 1 and can be transported to a receiving, second unit 2, by means of a conveyor 3.

The invention is based on the assumption that material treated in the unit 1 will produce individual particles or several particles which are heated to a temperature at which the particle or particles is/are liable to initiate fire and/or explosion in the system. One example in this regard is the disintegration of paper pulp which enters a mill 1 in the direction of the arrow 4 and from which the ultimate cellulose fluff is transported to the second unit 2, in the form of a silo, on a conveyor path 3 which includes a conduit system 7, 8, 9 with the aid of an airstream 6. Disintegration of the paper pulp in the unit 1 may result in individual particles or several discrete particles being heated to a temperature which is sufficiently high to cause a fire and/or explosion at least within the second part or second unit 2, and also within the particle transportation system 3.

Although the exemplifying embodiment is described with reference to the disintegration of paper pulp which is transported to a silo with the aid of an air stream, it will be obvious that the inventive concept can also be applied in other fields and for other purposes.

Another requirement is that the particles resulting from said disintegration are transported as loose material by a gas or gas mixture, normally air.

Another requirement is that the nature of the treatment carried out in the unit 1 is such as to be liable to produce particles whose heat content can constitute a risk of fire in the conduit system or in a storage space, i.e., in the so-called risk zone.

According to the present invention, the system 3 by means of which the loosely formed material exiting in the conduit 5 is transported between the first unit 1 and the second unit 2 includes, among other things, a stabilizing zone 7, an indicating zone 8 which functions to indicate hazardous high-temperature particles, and an extinguishing zone 9 which precedes the second unit or risk zone 2.

The indicating zone 8 includes initially a plurality of known sensors 10, for instance of the kind described and illustrated in U.S. Pat. No. 3,824,392 to Tibbling, or other types of sensors that are able to detect the presence of such particles.

Several sensors 10 are able to coact with an indicating and activating unit 12 via a line 11.

A high-temperature particle indicated by a sensor 10 will result in the unit 12 activating a device 15 which is associated with the extinguishing zone 9 and which delivers an extinguishing agent and/or removes the hazardous high-temperature particles.

In accordance with the invention, the detection-dependent intensity sensed in one or more sensors 10 can be evaluated in a circuit 16 included in the indicating and activating unit 12, and one of several available, indicated, and suitable measures or procedures can be activated in a calculating circuit 17 through the medium of a circuit 18.

The measures activated in this way may include one of a number of available devices, such as one of three devices 19, 20, and 21. Both the measure activated and procedure activated depend on the nature of the activation signal on the lines 19*a*, 20*a* or 21*a*.

Alternatively, one and the same device can be used to a greater or a lesser extent, by modifying the signal on one of the lines.

The invention also provides the possibility of programming the calculating circuit 17 so that the measure or procedure to be taken will be chosen by the circuit in accordance with the nature of the process, which can be loaded through a circuit 25 coupled to the unit 12.

Figure 6:
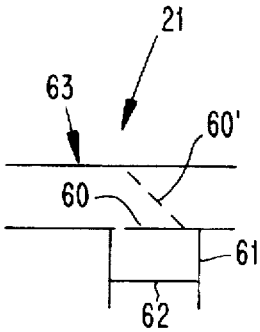
FIG. 6 illustrates one embodiment of a material deflecting valve.

In this regard, the measure or procedure chosen may constitute activation of the device 21 having a valve which is mounted in the conduit section 9 and which functions to deflect a particle collection which includes said hazardous particles in accordance with FIG. 6, which illustrates a valve flap 60 inclined at a position 60', shown in broken lines, at which the flap functions to deflect particles into a discharge conduit 61.

The discharge conduit 61 includes a further valve flap 62, which may also be moved to an open position. Also shown is a fire extinguishing system 63.

The sensor 10 is placed at a distance from the first unit 1 such that generated particles of low energy contents will pass respective sensors without initiating activation of the unit 12 and therewith without initiating a safety measure or procedure via the unit 18.

Figure 2:
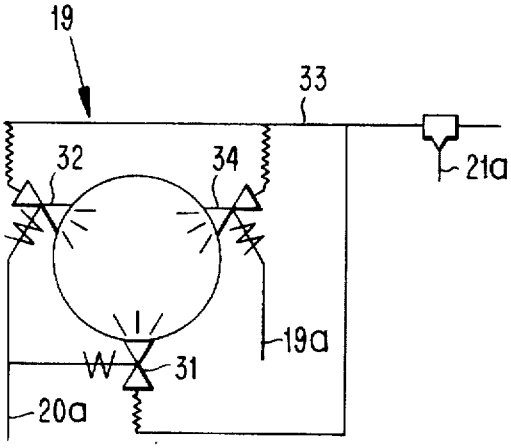
FIG. 2 illustrates a device in the form of a water-bearing extinguishing system provided with several nozzles, this system being chosen from among several available devices.

The aforementioned safety measures or safety procedures may also include the activation of the whole of a water-based extinguishing system or of solely parts of said system, in accordance with FIG. 2, where different nozzles of one of the exemplary safety measures 19 can be activated with the aid of signals arriving on the lines 19*a* and 20*a*.

The signal on the line 20*a* will activate two solenoid valves 31 and 32, in response to which the material under transportation will be sprayed with water held under pressure in the water delivery system 33.

The signal on the line 19*a* will activate one single additional solenoid valve 34.

The water delivery system is shut down in response to a signal on the line 21*a*.

In this case, the calculating unit 17 will select a safety measure or procedure and also the duration over which the safety measure or procedure shall remain in effect, in a simple programmable manner.

The unit 12 may also be programmed via a circuit 26 for the purpose of taking into account process internal conditions, such as the nature of the chosen material, a necessary time delay depending on the instant speed at which material is transported, and where the instant speed can be evaluated by a sensor 10*a*; and a signal corresponding to this speed is sent to the circuit 17 on a line 11*a*.

The unit 12 may also be programmed to take into account the construction and method of operation of the extinguishing equipment, so that the extinguishing zone will become active immediately before a hazardous particle or hazardous particles enters or enter said zone.

Figure 3:
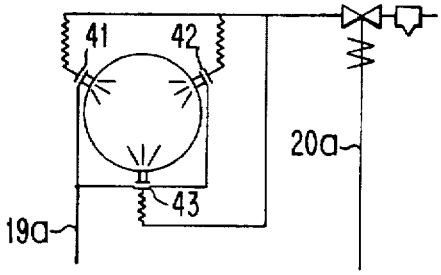
FIG. 3 illustrates another of said available devices in the form of a water-carried extinguishing system which includes a system locking plate that can be released by explosion.

FIG. 3 illustrates a water-based extinguishing system which includes an explosive locking plate release.

A solenoid valve is opened in response to a signal on the line 20*a* and the locking plates 41, 42, and 43 are released in response to a signal on the line 19*a*, so as to activate the nozzles of the system. The absence of a signal on the line 20*a* causes the valve to close.

Figure 4:
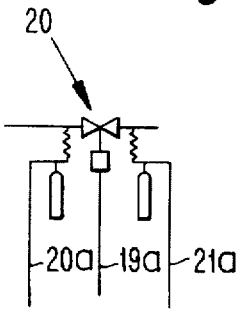
FIG. 4 illustrates a third embodiment of one of said available devices, in the form of a mist curtain and/or a gas release.

FIG. 4 illustrates an alternative embodiment of the invention for use when water cannot be used as an extinguishing agent in the extinguishing zone. In this case, extinguishing of the hazardous, high temperature particles is achieved by the device 20 which delivers $CO_2$, $N_2$, or saturated steam or some similar agent.

A signal on the line 19*a* will activate steam injection equipment, whereas a signal on the line 20*a* will cause the valve of a gas bottle to open, and a signal on the line 21*a* will cause the valve of a further gas bottle to open.

The valves remain open for the duration of the signal on respective lines.

It is possible, in accordance with the invention, to chose one or more of the aforesaid safety measures or procedures with the aid of the circuit 18, in accordance with the level of sensed intensity and in accordance with the chosen intensity levels.

Figure 5:
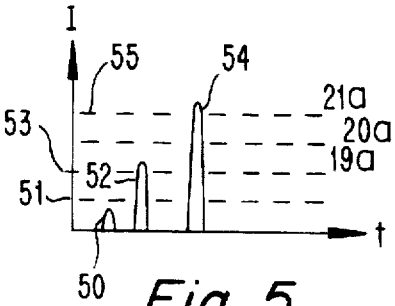
FIG. 5 is intended to illustrate how particles having different energy levels initiate different intensities in the sensor or sensors and therewith create conditions for the selection of an appropriate measure or procedure.

FIG. 5 illustrates schematically the limit values for given signal levels delivered by the sensors 10, and also shows that the limit values can vary up and down depending on the nature of the process among other things.

Signal intensity beneath a given level 51 is ignored, such as the signal 50.

The intensity of the signal 52 exceeds a level 53 and can be considered to instigate the choice of limited extinguishment, for instance by activating a nozzle 34 in FIG. 2, the delivery of steam in accordance with FIG. 4, or some like measure.

The intensity of the signal 54 exceeds the level 55 and requires full effect and a well-balanced activation time.

The unit 12 may, of course, also coact with an alarm system in a known manner, via a line 32.

The sensor 10 may conveniently have the form of the sensor arrangement illustrated and described in a U.S. patent Ser. No. 06/624,486 entitled "Detector Arrangement" filed on Apr. 4, 1996.

It will be understood that the invention is not restricted to the aforedescribed and illustrated exemplifying embodiment thereof and that modifications can be made within the scope of the inventive concept as illustrated in the following claims.

I claim:

1. A preventive safety system comprising:

means for transporting material between a first unit and a second unit, an indicating zone for indicating a presence of hazardous particles, an indicating and activating unit, and an extinguishing zone having a device located therein, the indicating zone including a hazardous particle sensor for coacting with the indicating and activating unit, the device located in the extinguishing zone including extinguishing means for delivering an extinguishing agent and removing means for removing said hazardous particles from the system, the indicating and activating unit including:

means for evaluating an intensity of hazardous particle temperature, means for selectively activating one of the extinguishing means and the removing means in response to the evaluating means, and means for selectively adjusting operation of the extinguishing means in response to the evaluating means.

2. A system according to claim 1, wherein the extinguishing means is a plurality of spray nozzles.

3. A system according to claim 1, wherein the removing means is a valve which deflects a particle collection containing said hazardous particles.

4. A system according to claim 1, wherein the sensor is placed at a distance from the first unit such that generated particles of low energy content will pass the sensor without causing the means for selectively activating to activate.

5. A system according to claim 1, wherein the means for selectively adjusting the operation of the extinguishing means partially activates a water-based extinguishing system.

6. A system according to claim 1, wherein the means for selectively adjusting the operation of the extinguishing means partially activates the extinguishing means.

7. A system according to claim 1, further comprising means for programming the indicating and activating unit.

8. A system according to claim 1, further comprising means for programming the indicating and activating unit such that the extinguishing means will be activated when at least one of the hazardous particles enters the extinguishing zone.

9. A system according to claim 1, wherein the extinguishing means is a system for delivering one of steam and gas.

10. A system according to claim 1, wherein the indicating zone includes a plurality of said sensors, all of said sensors for coacting with the indicating and activating unit.

* * * * *